United States Patent [19]

Genick

[11] Patent Number: 4,977,697

[45] Date of Patent: Dec. 18, 1990

[54] FOLDABLE TRAFFIC BARRIER

[76] Inventor: Raymond M. Genick, 5030 Auburn Rd., Utica, Mich. 48087

[21] Appl. No.: 532,056

[22] Filed: Jun. 1, 1990

[51] Int. Cl.[5] ..... G09F 15/00

[52] U.S. Cl. ..... 40/606; 40/610; 40/539

[58] Field of Search ..... 40/152.1, 610, 155, 40/152.2, 539, 591, 592

[56] References Cited

U.S. PATENT DOCUMENTS

| | | | |
|---|---|---|---|
| 337,544 | 3/1886 | Yaggy | 40/120 |
| 735,486 | 8/1903 | Fels | 40/610 |
| 1,704,377 | 3/1929 | Tinsley | 40/539 |
| 2,186,913 | 1/1940 | Jonas | 40/610 |
| 3,471,958 | 10/1969 | Westin | 40/592 |
| 3,589,328 | 6/1971 | Kiniry et al. . | |
| 3,593,681 | 7/1971 | Sernovitz . | |
| 3,618,556 | 11/1971 | Dietrich . | |
| 3,620,496 | 11/1971 | Bolt et al. . | |
| 3,625,177 | 12/1971 | Miller . | |
| 3,690,620 | 9/1972 | Matson et al. | 248/459 |
| 3,742,897 | 7/1973 | Meek et al. . | |
| 3,759,214 | 9/1973 | Evans et al. . | |
| 3,766,881 | 10/1973 | Ward . | |
| 3,773,012 | 11/1973 | Lindner et al. . | |
| 3,933,119 | 1/1976 | Hedgewick et al. . | |
| 4,197,807 | 4/1980 | Campbell . | |
| 4,466,376 | 8/1984 | Wells . | |
| 4,586,279 | 5/1986 | Hopkins . | |
| 4,592,158 | 6/1986 | Seely . | |

*Primary Examiner*—Kenneth J. Dorner
*Assistant Examiner*—Cassandra Hope
*Attorney, Agent, or Firm*—Peter D. Keefe

[57] ABSTRACT

A traffic barrier composed of a unitary panel having a plurality of folds for permitting it to be folded into an A-frame composed of two message panels connected at an apex, the A-frame having a base. The folds in the unitary panel include: a center fold, which forms the apex of the A-frame two bottom folds each spaced a first predetermined distance from the center fold, which define a bottom panel adjacent each message panel, and two flange folds spaced a second predetermined distance from the center fold, which define a flange adjacent the end of each bottom panel. The base is established either by an interlocking tab and slot system located adjacent the flanges or by an adhesive interconnecting the two flanges.

9 Claims, 1 Drawing Sheet

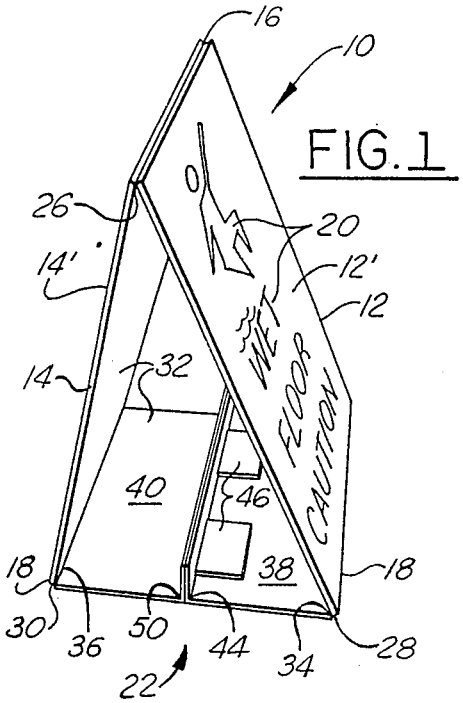
FIG. 1
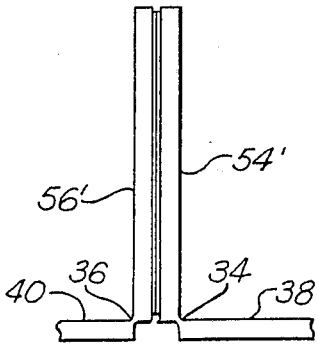
FIG. 4
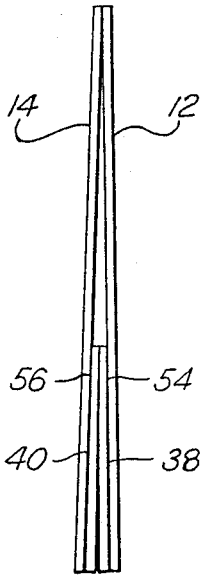
FIG. 5
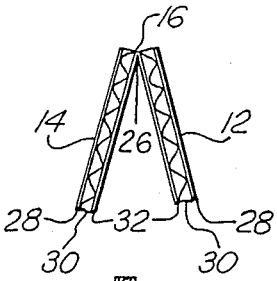
FIG. 2
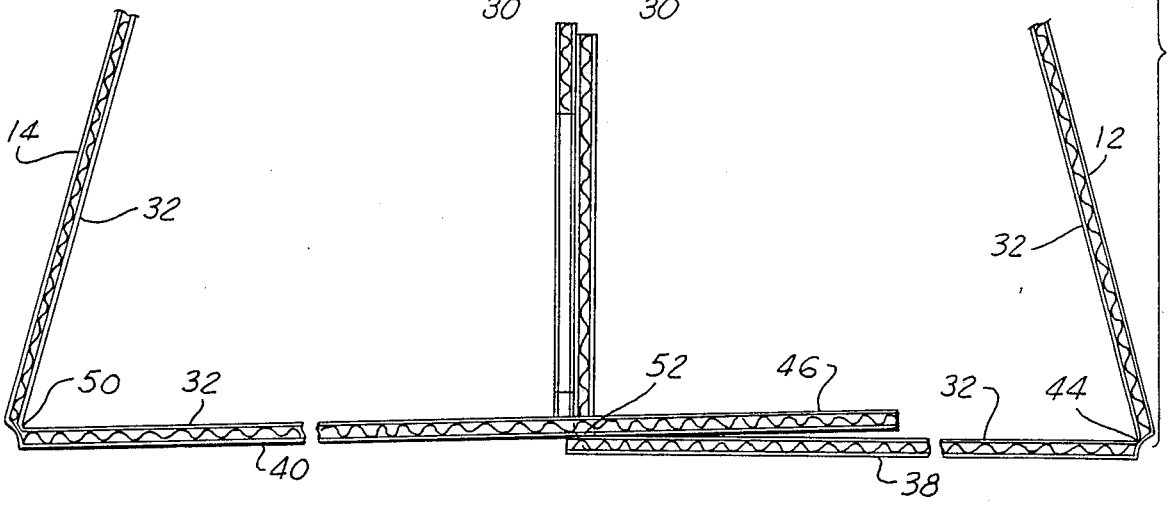
FIG. 3
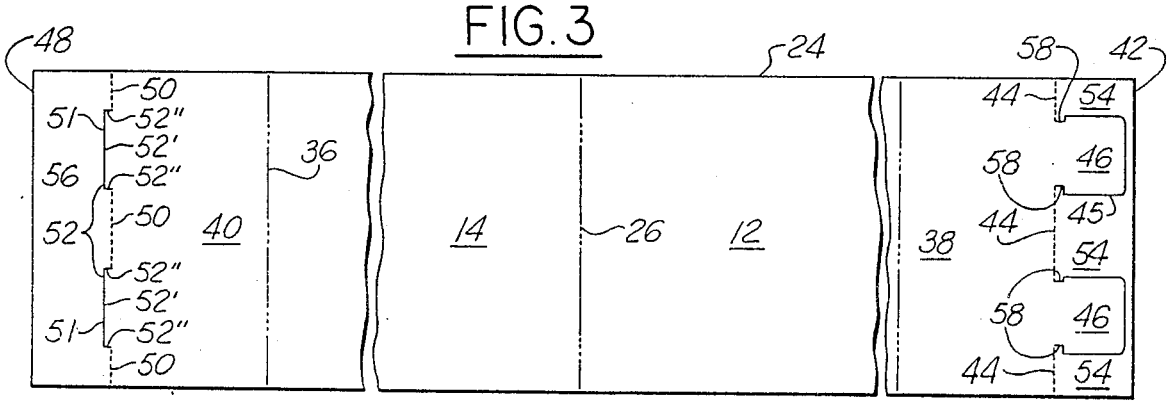

FOLDABLE TRAFFIC BARRIER

BACKGROUND OF THE INVENTION

1. Field of the Invention

The present invention is related generally to traffic barriers, and more particularly to a portable two sided traffic barrier which is compactly foldable.

2. Description of the Prior Art

Traffic barriers have been used over the years as a means to direct movement of people and vehicles. Generally, portable traffic barriers are used for temporary purposes in order to direct traffic, such as during maintenance or repair operations of a surface. Portable traffic barriers have been developed in the prior art which permit the portable traffic barrier to be set down upon a surface, and the shape thereof and indicia thereon serves to alert people, as desired.

A very common type of portable traffic barrier is a cone. One such cone is described in U.S. Pat. No. 3,618,556 to Ditrich, dated Nov. 9, 1971, which discloses a cone shaped toppiece which sits above a circular base, the base in this case being inflatable. Another cone is represented by U.S. Pat. No. 4,197,807 to Campbell, dated Apr. 15, 1980, which discloses a cylindrical base to which is connected to a collapsible spiral which may nest within the base. Still another cone is represented by U.S. Pat. No. 4,466,376 to Wells, dated Aug. 21, 1984, which discloses a selectively foldable upright polygon which connects to a selectively foldable base.

Another very common type of portable traffic barrier is a triangular marker. Examples of triangular markers are: U.S. Pat. No. 3,589,328 to Kiniry, dated June 29, 1971, which discloses a triangle constructed of three members which allow for quick assembly; U.S. Pat. No. 3,593,681 to Sernovitz, dated July 20, 1971, which discloses a foldable triangular marker having an attached flag pole; U.S. Pat. No. 3,625,177 to Miller, dated Dec. 7, 1971, which discloses a foldable triangularly shaped portion which selectively engages a base member; U.S. Pat. No. 3,742,897 to Meek et al, dated July 3, 1973, which discloses a folding triangular reflector member which selectively engages a box base; U.S. Pat. No. 3,759,214 to Evans et al, dated Sept. 18, 1973, which discloses three legs forming a collapsible triangle having a brace member; U.S. Pat. No. 3,766,881 to Ward, dated Oct. 23, 1973, which discloses a portable traffic warning device constructed of three pivotably joined elongated members; U.S. Pat. No. 3,773,012 to Lindner et al, dated Nov. 20, 1973, which discloses a collapsible leg assembly which forms a triangle, the leg assembly resting upon a pedestal; and U.S. Pat. No. 3,933,119 to Hedgewick et al, dated Jan. 20, 1976, which discloses a traffic warning device composed of a collapsible body having three legs.

In spite of the range of prior art devices recounted above, there yet remains several disadvantages in conventional traffic barrier devices. The first class of traffic barriers, cones, are relatively expensive and are generally not adaptable for the display of messages. The second class of traffic barriers, triangles, are frequently somewhat expensive and only the edge of the triangles is used to convey traffic information, again resulting in difficulty adapting these devices for purposes of conveying messages.

SUMMARY OF THE INVENTION

The present invention is a portable traffic barrier which is inexpensive, reusable, easily assembled and disassembled, compactly foldable for storage, and has large surface areas for providing a warning or other message.

The present invention is a traffic barrier composed of a unitary panel having a plurality of folds for permitting it to be folded into an A-frame composed of two message panels connected at an apex, the A-frame having a base. The folds in the unitary panel include: a center fold, which forms the apex of the A-frame; two bottom folds each spaced a first predetermined distance from the center fold, which define a bottom panel adjacent each message panel; and two flange folds spaced a second predetermined distance from the center fold, which define a flange adjacent the end of each bottom panel.

In the preferred embodiment, the bottom panels mutually engage via a slot and tab system. Starting with a flat unitary panel, assembly of the traffic barrier begins by folding the unitary panel at, respectively, the center and two bottom folds so as to form the message panels and the base panels. Next, further folding of the unitary panel at the flange folds causes the flanges to assume an orientation generally perpendicular to the base panels and for the slots and tabs to erupt. Finally, the tabs are pressed into the slots thereby forming an A-frame with a base. Disassembly for purposes of storage or shipping is accomplished by simply reversing the aforesaid steps. In a variation of the aforesaid traffic barrier, the flanges are simply placed into mutual adjacency and an adhesive therebetween holds them together. In this variation of the traffic barrier according to the present invention, the center fold, the two bottom folds and the two flange folds cooperate to permit the portable traffic barrier to be very easily folded for shipping or storage simply by moving each bottom of the message panels towards each other, the base panels and flanges folding toward the apex. Similarly, folding for use is simply accomplished by separating the bottom of each of the two message panels, the base panels and flanges folding away from the apex during this step.

Accordingly, it is an object of the present invention to provide a portable traffic barrier having two message panels in the form of an A-frame structure.

It is a further object of the present invention to provide a portable traffic barrier which is inexpensive and reusable.

It is another object of the present invention to provide a portable traffic barrier which is simple to assemble and disassemble.

It is yet a further object of the present invention to provide a portable traffic barrier which is foldable into a very compact unit, but which can be assembled into a substantial sized, easily seen warning or message device.

It is still a further object of the present invention to provide a portable traffic barrier which is constructed of a unitary panel which has a plurality of folds which define two message panels, as well as two bottom panels which are mutually joined; folds being provided which allow the unitary panel to be folded into an A-frame shape, and then folded into a relatively thin planar shape.

It is still a further object of the present invention to provide a portable traffic barrier which is constructed of a unitary panel which has a plurality of folds which define two message panels, as well as two bottom panels which are mutually joined; folds, tabs and slots being provided which allow the unitary panel to be folded and thereupon assembled into an A-frame shape, and then disassembled and folded into a relatively thin approximately planar shape.

These, and additional objects, advantages, features and benefits of the present invention will become apparent from the following specification.

BRIEF DESCRIPTION OF THE DRAWINGS

FIG. 1 is a perspective view of the traffic barrier according to the present invention in which base panel tabs are inserted into base panel slots in order to assemble an A-frame of two message panels, the A-frame having a rigitizing base.

FIG. 2 is a part cut-away side view of the traffic barrier of FIG. 1, showing in cut-away detail the base and apex thereof.

FIG. 3 is a plan view of the unitary panel from which the traffic barrier of FIG. 1 is assembled.

FIG. 4 is a detail side view of a portion of the base showing an alternative base panel connection system in order to assemble an A-frame of two message panels.

FIG. 5 is a side view of the traffic barrier which incorporates the alternative base panel connection system depicted in FIG. 4, shown in its storage orientation.

DETAILED DESCRIPTION OF THE PREFERRED EMBODIMENT

Referring now to the Drawing, FIG. 1 shows the traffic barrier 10 according to the present invention in operation. The traffic barrier is composed of two message panels 12 and 14 which are foldably joined at an apex 16, thereby forming an A-frame shaped structure when the panel bottoms 18 of each message panel are mutually separated as shown. Each of the outwardly facing sides 12' and 14', respectively, of the panels 12 and 14 may be provided with written and/or pictorial indicia 20 which may convey, for instance, a warning (as shown) or an informational message. Alternatively, the facing sides 12' and 14' may be simply brightly colored, without having thereon any specific indicia, the bright color conveying by itself a message to passersby. The two message panels 12 and 14 are held in the A-frame shape via a base, 22, as will be elaborated in detail below. As an example, the traffic barrier 10 may be used on streets, hallways, and as an emergency sign for disabled passenger cars (which, in the latter use, is normally stored folded in the trunk).

It is preferred for the traffic barrier 10 to be constructed from a unitary piece of planar material. A preferred material is corrugated plastic, although corrugated cardboard is also acceptable, though it is not as durable nor impervious to water as is corrugated plastic. FIG. 3 shows generally a unitary panel 24 from which may be assembled the traffic barrier 10. The unitary panel 24 has a plurality of folds and pre-cut tabs and slots which allow for assembly thereof into the traffic barrier 10 in a manner to be described. While a rectangular unitary panel 24 is shown in FIG. 3, other shapes are contemplated within the scope of the present invention. For instance, each message panel 12, 14 may have a trapezoidal shape, in which case the apex 16 would be oriented parallel with respect to each of the panel bottoms 18, but the apex would extend a shorter linear distance than would the panel bottoms.

Referring now to FIGS. 1 through 3, details of construction and assembly/disassembly of the traffic barrier 10 will be discussed.

At the center of the unitary panel 24 is a center fold 26, the center fold being at the apex 16 when the panels 12 and 14 are folded into the A-frame shape of FIG. 1. It is preferred to provide the center fold 26 by scoring the unitary panel through the outside wall 28 and the corrugation 30, but not through the inside wall 32, so that the inside wall serves flexibly to accommodate folding at the center fold. At the bottom 18 of message panel 12 is a first bottom fold 34 and at the bottom 18 of message panel 14 is a second bottom fold 36. The location of the bottom folds 34, 36 in relation to the center fold 26 is determined by the desired height of the message panels 12, 14. Each of the bottom folds 34 and 36 are preferred to be provided in the unitary panel 24 in the manner above described relative to the center fold 26. Spaced from the first bottom fold 34 is a first flange fold 44 which is preferred to be provided in the unitary panel 24 in the manner described with respect to the center fold 26. Adjacent the first flange fold 44 is a die cut 45 defining a set of tabs 46. It is preferred for the first flange fold 44 to extend across the unitary panel 24 everywhere except along the tabs 46, as shown in FIG. 3, so that the tabs will not be weakened by scoring. Spaced from the second bottom fold 36 is a second flange fold 50 which is preferred to be also provided in the unitary panel 24 in the manner described with respect to the center fold 26. Adjacent the second flange fold 50 is a die cut 51 defining a set of slots 52. For purposes of die cutting, it is preferred to make a straight cut 52' and two short cuts 52" perpendicular thereto so that when the unitary panel 24 is folded at the fold 50, the set of slots 52 will erupt, each having a height defined by the length of the short cuts 52". For this purpose, it is preferred for the first flange fold 50 to intersect the short cuts 52" so that folding will be along the slots 52 at the point thereof nearest the center fold 26. The location of the first and second flange folds is determined by the desired width of the base 22 of the A-frame, where each base panel 38 and 40 are of the same width equal to one-half the base. Also, the first and second flange folds define flanges 54 and 56.

As an example of dimensions of the traffic barrier 10, the unitary panel measures 12 inches wide by 60 inches long by one-eighth inch thick, and the center fold is located 30 inches from either end 42, 48; each bottom fold is located 20 inches either side of the center fold; and each flange fold is located 27 inches either side of the center fold. Accordingly, each message panel measures 12 inches by 21 inches; each base panel measures 12 inches by 6 inches; and each flange measures 12 inches by 3 inches. Further, in this example, each tab measures 3.5 inches wide by 2.5 inches long, while each slot measures about one-eighth inch high and somewhat under 3 inches wide in order to ensure a friction fit with the tabs. When assembled according to these dimensions, the traffic barrier 10 has a base which measures 12 inches by approximately 12 inches long, and the angle between the message panels at the apex 16 of the A-frame is approximately 35 degrees.

To assemble the traffic barrier 10 from the unitary panel 24, the user would first fold the unitary panel at the center fold so as to bring the inside walls 32 toward each other. Next, each of the base panels 38 and 40 are folded along their respective bottom folds 34 and 36 in the direction of bringing the inside wall 32 of the bottom panel toward the inside wall 32 of its adjacent message panel. Next, the bottom panels are further folded along the flange folds 44 and 50, again in the direction of bringing the inside walls 32 into proximity until the flanges 54 and 56 are generally perpendicular with respect to base panels 38 and 40, respectively. In the process of performing the folding operation at flange fold 44, the set of tabs 46 will erupt, and in the process of performing the folding operation at fold 50 the set of slots 52 will erupt. Finally, the user carefully inserts the set of tabs into the set of slots, as the flanges 54 and 56 progressively move closer together. As can be seen particularly in FIG. 3, it is preferred for the cut-out 45 at the tabs 46 to provide small edge cuts 58 adjacent the fold 44. The purpose of these edge cuts 58 is to provide for selectively releasable mechanical interlocking of the tabs with respect to the slots in addition to frictional engagement therebetween as adduced by the relative size of the tabs in relation to the slots.

Disassembly of the traffic barrier 10 is a simple reversal of the aforesaid assembly steps.

FIG. 4 depicts a variation in effecting mutual connection of the flanges 54 and 56. In this variation, there are folds 44 and 50 in the unitary panel 24, but there are no die cuts. Rather, when assembly as recounted above has reached the point of the flanges 54' and 56' mutually meeting, an adhesive retains them in mutually parallel adjacency.

In the variation of the traffic barrier 10 depicted in FIG. 4, once the flanges 54' and 56' are united by the adhesive, they need never be again detached in order to unfold the A-frame. In this case the A-frame may be conveniently unfolded by moving the flanges 54' and 56' toward the apex 16, while folding ensues along the center fold 26, along the bottom folds 34 and 36, and along the flange folds 44 and 50 until the inside wall of the bottom panels rests against the inside wall of the message panels. In this state, the traffic barrier 10 is collapsed into a very compact, near planar configuration, as shown in FIG. 5. To unfold the traffic barrier 10, the aforesaid steps are very effortlessly reversed.

To those skilled in the art to which this invention appertains, the above described preferred embodiment may be subject to change or modification. For instance, materials other than corrugated can be used. Further, while it is preferred that the traffic barrier 10 be assembled from a unitary panel, each of the message panels, bottom panels and flanges can be each discrete members which are flexibly joined in any manner within the ordinary skill of the artisan. Still further, it is possible to provide the various enumerated folds without scoring. Yet further, it is possible to provide one tab for interlocking with one slot, or to provide more than two tabs for interlocking with a similar number of slots. Such change or modification can be carried out without departing from the scope of the invention, which is intended to be limited only by the scope of the appended claims.

What is claimed is:

1. A foldable traffic barrier, comprising:

a first message panel having a first end and a second end;

a second message panel having a first end and a second end, said first end of said second message panel being foldably connected to said first end of said first message panel, the foldable connection of said first message panel to said second message panel defining an apex;

a first bottom panel having a first end and a second end, said first end of said first bottom panel being foldably connected to said second end of said first message panel;

a second bottom panel having a first end and a second end, said first end of said second bottom panel being foldably connected to said second end of said second message panel;

a first flange foldably connected to said second end of said first bottom panel;

at least one first die cut in said first flange defining at least one tab, said at least one first die cut in said first flange being located adjacent said second end of said first bottom panel;

a second flange foldably connected to said second end of said second bottom panel; and at least one second die cut in said second flange defining at least one slot, said at least one second die cut in said second flange being located adjacent said second end of said second bottom panel;

whereby said at least one tab may be selectively inserted into said at least one slot until each of said first and second flanges mutually contact, thereby causing said first message panel and said second message panel to mutually assume an A-frame shape.

2. The foldable traffic barrier of claim 1, wherein said traffic barrier is assembled from a unitary panel.

3. The foldable traffic barrier of claim 2, wherein said unitary panel is constructed of corrugated panel material.

4. The foldable traffic barrier of claim 3, wherein said unitary panel has an inside wall, an outside wall and corrugation therebetween, said unitary panel being scored at each said fold, said score being through said outer wall and said corrugation.

5. The foldable traffic barrier of claim 4, wherein said at least one tab further includes at least one edge cut located adjacent said second end of said first bottom panel for mechanically interlocking with said at least one slot.

6. A foldable traffic barrier, comprising:

a first message panel having a first end and a second end;

a second message panel having a first end and a second end, said first end of said second message panel being foldably connected to said first end of said first message panel, the foldable connection of said first message panel to said second message panel defining an apex;

a first bottom panel having a first end and a second end, said first end of said first bottom panel being foldably connected to said second end of said first message panel;

a second bottom panel having a first end and a second end, said first end of said second bottom panel being foldably connected to said second end of said second message panel;

a first flange foldably connected to said second end of said first bottom panel;

a second flange foldably connected to said second end of said bottom panel; and interconnection means connected with at least one of said first flange and second flange for interconnecting said first flange with second flange;

whereby said first message panel and said second message panel mutually assume an A-frame shape when said first and second flanges are oriented perpendicularly to said bottom panels, further whereby said first and second message panels are substantially in mutual adjacency when said first and second flanges are oriented substantially parallel with respect to said first and second bottom panel.

7. The foldable traffic barrier of claim 6, wherein said traffic barrier is assembled from a unitary panel.

8. The foldable traffic barrier of claim 7, wherein said unitary panel is constructed of corrugated panel material.

9. The foldable traffic barrier of claim 8, wherein said interconnection means is an adhesive.

* * * * *